United States Patent [19]

Martin

[11] 4,135,713

[45] Jan. 23, 1979

[54] REVOLVING SKIPPING DEVICE AND COUNTER

[75] Inventor: Harold B. Martin, West Caldwell, N.J.

[73] Assignee: Graber-Rogg, Inc., Cranford, N.J.

[21] Appl. No.: 866,802

[22] Filed: Jan. 3, 1978

Related U.S. Application Data

[63] Continuation-in-part of Ser. No. 749,840, Dec. 13, 1976, abandoned.

[51] Int. Cl.[2] ..... A63B 5/20; G06M 1/22

[52] U.S. Cl. ..... 272/74; 235/95 C; 272/DIG. 5

[58] Field of Search ..... 272/74, 75, DIG. 5; 273/DIG. 26; 235/95 C, 95 B

[56] References Cited

U.S. PATENT DOCUMENTS

| | | | |
|---|---|---|---|
| 181,726 | 8/1876 | Savage et al. | 272/75 |
| 233,224 | 10/1880 | Flynt et al. | 272/75 |
| 360,269 | 3/1887 | Beach | 235/95 C |
| 468,371 | 2/1892 | Teate | 235/95 C |
| 718,104 | 1/1903 | Dixon | 235/95 C |
| 1,189,307 | 7/1916 | Stokes et al. | 272/75 |
| 3,074,717 | 1/1963 | Lutz | 272/74 |
| 3,118,666 | 1/1964 | Fitch | 272/75 |
| 3,493,229 | 2/1970 | Ramsey | 272/74 |

FOREIGN PATENT DOCUMENTS

| | | | |
|---|---|---|---|
| 408300 | 1/1910 | France | 272/75 |
| 37 of | 1886 | United Kingdom | 235/95 C |
| 11374 of | 1892 | United Kingdom | 235/95 C |
| 13464 of | 1892 | United Kingdom | 235/95 C |
| 26360 of | 1909 | United Kingdom | 235/95 C |

*Primary Examiner*—Richard C. Pinkham
*Assistant Examiner*—Arnold W. Kramer

[57] ABSTRACT

A revolving skipping device has a crank with end portions connected to flexible loops over which a skipper may jump. The device includes a counter having a ratchet face with numerals indexed by one end of a pivoted pawl having a weighted mass on the other end cooperatively associated with the crank for recording the number of cycles jumped by the skipper.

5 Claims, 6 Drawing Figures

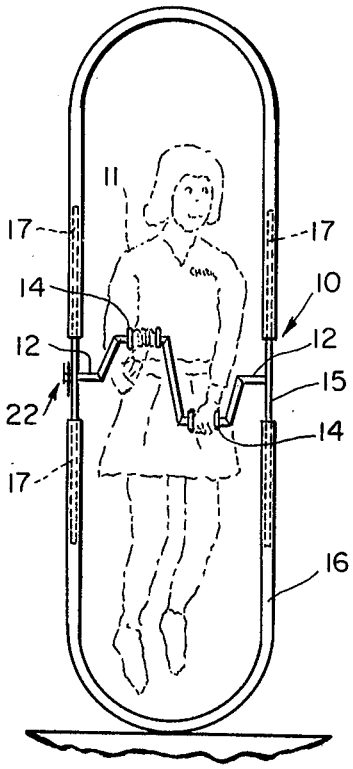
FIG. 1
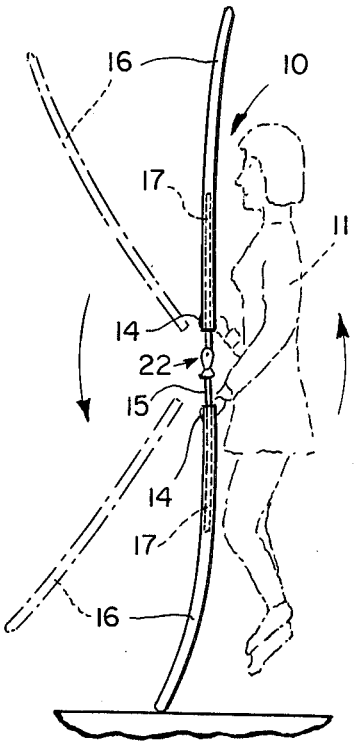
FIG. 2
FIG. 3
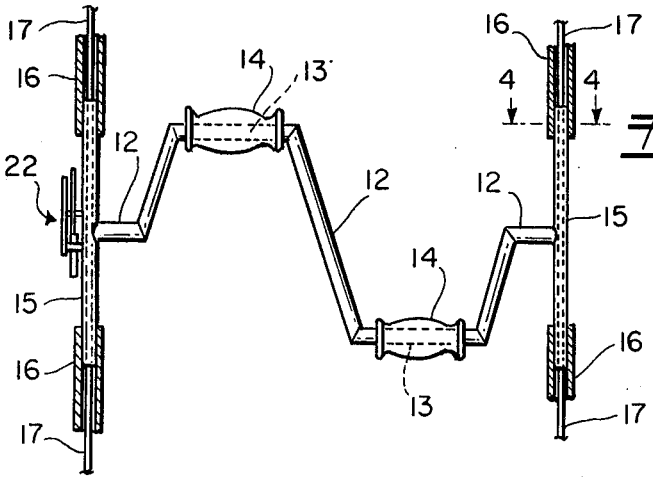
FIG. 4
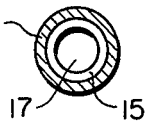

REVOLVING SKIPPING DEVICE AND COUNTER

This is a continuation-in-part application of Application Ser. No. 749,840, filed Dec. 13, 1976, and now abandoned.

BACKGROUND OF THE INVENTION

The principal object of this invention is to provide an improved revolving skipping device, which provides for multiple skipping per revolution of the device which is balanced and stabilized in operation and may be readily manipulated and operated by and completely under the control of the hands of the skipper. Further, the inventive device is readily operable for skipping over uneven terrain, is readily operable for turning and changing skipping directions and is readily usable by skippers of various heights and breadths. Further, the inventive device is simple and rugged in construction, is inexpensive to manufacture and easy to assemble, has utility in gymnasiums and the like for body building and exercising programs, and is pleasurable to use by children and also adults.

To this end, the inventive device is provided with a counter mechanism for recording cycles of jumps not only in an exercise program but also for determining the number of cycles jumped in a competitive event.

SUMMARY OF THE INVENTION

This invention relates to an improved skipping device. According to the invention there is provided a revolving skipping device comprising a rigid elongated transverse member having a pair of opposed crank portions adjacent the center thereof and extending substantially radially outwardly in opposite directions from the longitudinal central axis of the member and adapted to be grasped by the hands of a skipper in use of the device for freely movably supporting the member in front of and in proximity to the hips or waist of the skipper. A plurality of elongated portions at the ends of the member extend substantially radially outwardly therefrom in equally spaced relation. A plurality of relatively flexible loops are secured at their ends to the equally spaced substantially radially extending elongated end portions of the member so as to be revolved thereby over the head and under the feet of the skipper during use of the skipping device as the member is revolved about its longitudinal central axis, the loops substantially balancing and stabilizing the revolving skipping device about the longitudinal central axis of the member. A counter is attached to the transverse member for recording the number of revolutions of the transverse member during use of the skipping device and comprises a ratchet cooperatively associated with the crank and having a plurality of gear teeth and an indexing pawl cooperatively associated with the crank for engagement with the gear teeth, said indexing pawl being provided with an opposing weighted mass which generally tends to hang towards the ground.

DRAWINGS

Other objects and advantages will become apparent to those skilled in the art upon reference to the accompanying specification, claims and drawings, in which:

FIG. 1 is a front view of the revolving skipping device of this invention showing the same being manipulated by a skipper;

FIG. 2 is a side view of the revolving skipping device also showing it being manipulated by a skipper;

FIG. 3 is an enlarged view, partly in section, of the central portion of the revolving skipping device;

FIG. 4 is a further enlarged sectional view taken substantially along the line 4—4 of FIG. 3;

DESCRIPTION OF THE PREFERRED EMBODIMENT

Figure 5:
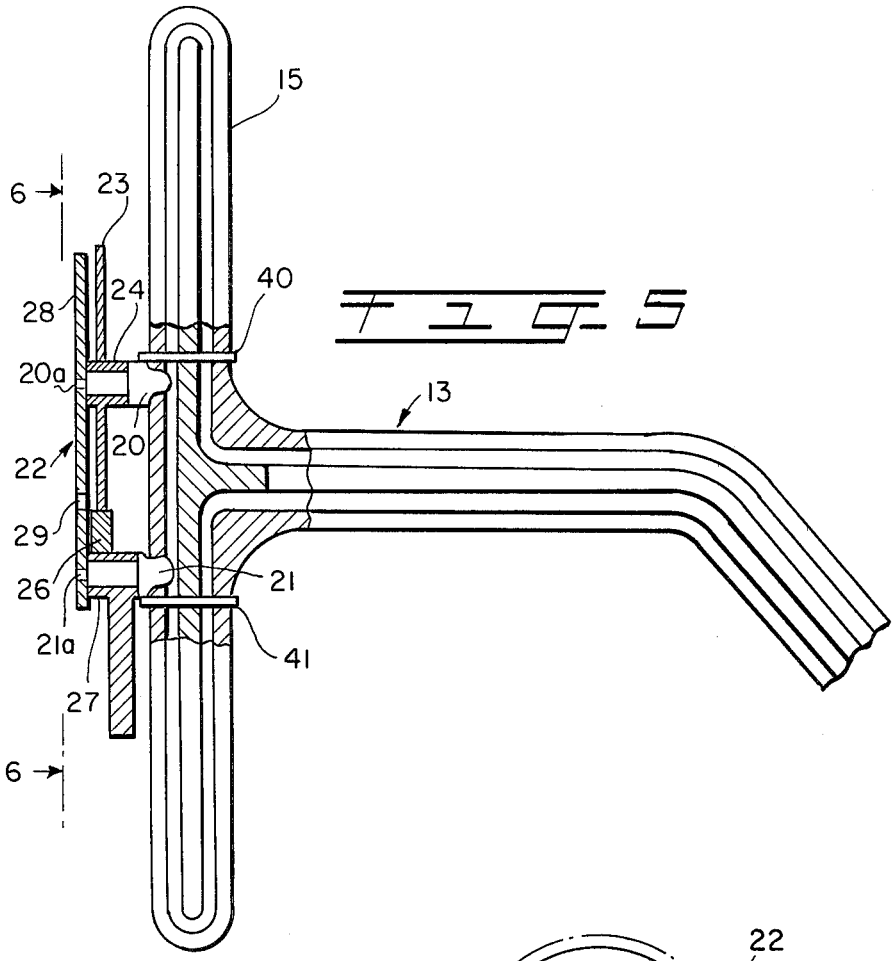
FIG. 5 is a partial cross-sectional view of a counter mechanism on the crank; and, FIG. 6 is a view taken along the lines 6—6 of FIG. 5.
Figure 6:
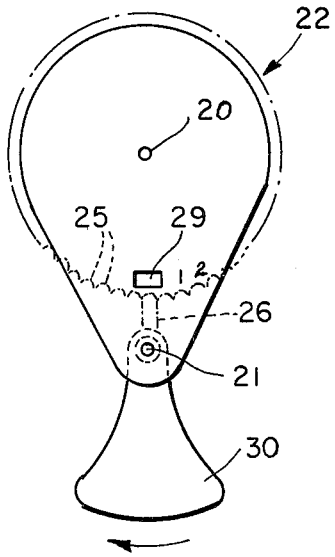

The revolving skipping device of this invention is generally designated at 10 and is illustrated in FIGS. 1 and 2 as being manipulated by a skipper 11. The revolving skipping device 10 includes a relatively rigid transverse member of crank 12 which is preferably longer than the breadth of the skipper. The crank may be formed of any suitable material such as plastic, metal or the like, and it may be either solid or tubualr, as desired. The crank 12 is provided adjacent to its center with a pair of opposed crank arms 13—13, which, in turn, may be provided with mounted rotatable handles 14. The crank arms 13—13 are grasped by the hands of the skipper for freely movably supporting the crank 12 in front of and in proximity to the hips or waist of the skipper and for desirably positioning and revolving the crank 12.

A plurality of elongated portions 15 are provided at the ends of the crank 12 and they extend substantially radially outwardly from the ends of the crank in equally spaced relationship. As illustrated, two elongated portions 15—15 are formed at the respective ends of the crank 12 and each extends radially outwardly in opposite directions from the crank and in parallel relationship with each other. Thus, as the crank 12 is revolved, its elongated end portions 15—15 are correspondingly revolved.

A plurality of flexible loops 16—16 are secured at their ends to the equally spaced substantially, radially extending elongated end portions 15—15 of the crank, said loops being revolved by the crank 12 to pass over the head and under the feet of the skipper. The loops 16—16 are preferably tubular and made from a suitable relatively flexible synthetic plastic material. The ends of the tubular loops 16—16 are telescoped snugly over the end portions 15—15 for securing the same thereto. The end portions 15—15 scribe a circle about the central axis of the crank 12 so that, as the crank 12 is revolved, the relatively flexible loops 16—16 are revolved about the scribed circle without damage of winding up on the crank 12. In other words, the elongated end portions 15 assure appropriate revolving of the relatively flexible loops 16—16.

Optionally, the end portions 15—15 are tubular in form for receiving rods 17—17 which may be formed of any desired material. The rods 17—17 extend beyond the ends of the elongated portions 15—15 for scribing a still larger circle for further controlling the loops 16—16. While not absolutely necessary, the rods 17—17 provide for better control for the rotation of the relatively flexible loops 16—16. Instead of utilizing rods 17—17, the elongated end portions 15—15 may be lengthened to any desired length for scribing the desired circle for rotating the loops 16—16. While only two relatively flexible loops 16—16 have been illustrated, additional equally spaced loops, such as three or four loops, may be utilized if desired. In the embodiment of FIG. 5, stops 40 and 41 are provided on the solid section end portions 15—15 to limit the extent to which the ends of the loops 16 may be slid over the end portion 15.

In an effort to keep an accurate record of the number of times the crank is revolved in either an exercise program or a competitive event for recording the number of crank revolutions during a particular amount of time, a counting mechanism is cooperatively associated with the revolving skipping device. Located on one crank end portion 15 are two integrally constructed fixed pivot posts or axles 20, 21 which extend in spaced parallel relationship to the axis of the crank arms 13—13. A counter, generally referred to at 22, is provided with a ratchet type counting wheel 23 having a centrally located hub 24 for snugly receiving post 20, the ratchet face being provided with peripherally located gear-like teeth 25—25. Located on the face of the ratchet are consecutively arranged numerals each of the numerals being depicted with its respective gear teeth.

An indexing pawl 26 is provided with a hub 27 for snugly receiving post 21, the free end of said indexing pawl communicating with the peripherally located gear-like teeth 25—25 of ratchet 23. Diametrically opposed to and offset from the indexing pawl 26 is a comparatively large, weighted mass 30 which is capable of moving between fixed posts 20, 21 during operation of crank 12.

A retainer 28 is provided with a pair of sockets 20*a*, 21*a*, for snugly receiving the extremities of pivot posts 20, 21, respectively, said retainer capable of holding the ratchet 23 and indexing pawl 26 in a fixed, meshing position during the revolving of the crank and for visually observing the numerals on the ratchet face 23 through a window 29 provided on the retainer. As the crank handle 13 is turned, the weighted mass 30 of the indexing pawl 26 continually hangs towards the ground so that the crank handle revolves relative to it, the weighted mass being free of interference with the operation of the ratchet and indexing pawl. The counter ratchet 23 is relatively stationary with respect to the crank handle, however, the net effect of revolving the crank forward once on its axis is to move the indexing pawl through one revolution which, in turn, correspondingly advances the counter ratchet one tooth. In other words, the ratchet moves simultaneously with the rotation of the crank, the pawl remaining in a relatively fixed position due to the weighted mass 30. During one rotation of the crank, one tooth 25 of the ratchet disengages from the pawl and a succeeding tooth engages said pawl, each ratchet tooth being consecutively numbered and circumferentially arranged on the ratchet face so that the number for each gear tooth engaging the pawl will be exposed through window 29. In so doing, successively higher numbers are exhibited through the window 29 of retainer 28 for each revolution of the crank. The counter is easily reset to zero, if desired, by lifting the indexing pawl out of engagement with the teeth on the counter and rotating the counter to its desired starting number.

The revolving skipping device, because of its multiple loops 16, provides for multiple skipping per revolution of the device. Since the device is symmetrical about its central axis, it is balanced and stabilized in operation. Since the revolving skipping device is supported only by the hands of the skipper, it may be readily manipulated and operated by the skipper, and this is enhanced by the location of the crank portions adjacent the center of the member, i.e., near the center of gravity thereof. The revolving device during use may be raised or lowered by the hands of the skipper to make possible skipping over an uneven terrain. Also, it may be readily positioned by the hands of the skipper for turning and changing skipping directions. Since it is supported solely by the hands of the skipper, it may be readily used by skippers of various heights. The revolving device is also adjustable by varying the effective length of the loops 16 to accommodate a wide range of skippers from tall to short.

While for purposes of illustration one form of this invention has been disclosed, other forms thereof may become apparent to those skilled in the art and therefore, this invention is to be limited only by the scope of the appended claims.

I claim:

1. A revolving skipping device having a crank portion, and a counter connected to the crank portion, said counter including:

a pair of fixed posts connected to the crank and located in spaced parallel relationship, a ratchet cooperatively associated with one post for revolving thereabout, said ratchet having numerals and gear teeth around the circumference thereof, an indexing pawl cooperatively associated with the other post for revolving thereabout, one end of said indexing pawl capable of meshing with the gear teeth, and an opposing weighted mass connected to the opposite end of said indexing pawl and generally hanging towards the direction of the ground, said weighted mass being offset from the common plane of the ratchet and pawl and capable of moving between said pair of fixed posts.

2. A revolving skipping device, according to claim 1, which further includes a retainer for securing the ratchet and indexing pawl to the posts.

3. A revolving skipping device, according to claim 2, wherein said ratchet is provided with a face having said numerals successively arranged (numerals) thereon, each numeral being associated with a respective gear tooth.

4. A revolving skipping device, according to claim 3, wherein said retainer is provided with means for observing the respective numerals on said ratchet face.

5. A revolving skipping device comprising:

an unsupported relatively rigid elongated transverse member longer than the breadth of the skipper and having a pair of opposed crank portions adjacent the center of the member and extending substantially radially outwardly in opposite directions from the longitudinal central axis of the member to be grasped by the hands of the skipper for freely movably supporting the member in front of and in proximity to the hips or waist of the skipper and for desirably movably positioning the member with respect thereto and revolving the member about its longitudinal central axis, a plurality of elongated portions at the ends of the member extending substantially radially outwardly therefrom in equally spaced relation and revolved thereby about the longitudinal central axis of the member, a plurality of relatively flexible loops secured at their ends to the equally spaced substantially radially extending elongated end portions of the member and revolved thereby over the head and under the feet of the skipper as the member is revolved about its longituninal central axis and operating by centrifugal forces to balance and stabilize the revolving skipping device about the longitudinal central axis of the member, and, counter means attached to the transverse member for recording the number of cycles jumped by the skipper, said counter means including a pair of fixed posts connected to the crank and located in spaced parallel relationship; a ratchet cooperatively associated with one post for revolving thereabout, said ratchet having numerals and gear teeth around the circumference thereof; an indexing pawl cooperatively associated with the other post for revolving thereabout, one end of said indexing pawl capable of meshing with the gear teeth; and an opposing weighted mass connected to the opposite end of said indexing pawl and generally hanging towards the direction of the ground, said weighted mass being offset from the common plane of the ratchet and pawl and capable of moving between said fixed pair of posts.

* * * * *